US010220279B2

(12) United States Patent
Lau et al.

(10) Patent No.: US 10,220,279 B2
(45) Date of Patent: Mar. 5, 2019

(54) HANDLE SHELL FOR BALL GAME RACKET

(71) Applicant: Head Technology GmbH, Kennelbach (AT)

(72) Inventors: Daniel Lau, Dornbirn (AT); Harald Rosenkranz, Lauterach (AT); Stefan Mohr, Dornbirn (AT)

(73) Assignee: Head Technology GmbH, Kennelbach (AT)

( * ) Notice: Subject to any disclaimer, the term of this patent is extended or adjusted under 35 U.S.C. 154(b) by 0 days.

(21) Appl. No.: 15/672,919

(22) Filed: Aug. 9, 2017

(65) Prior Publication Data

US 2018/0043225 A1 Feb. 15, 2018

(30) Foreign Application Priority Data

Aug. 10, 2016 (DE) ..... 10 2016 009 720

(51) Int. Cl.

| | |
|---|---|
| ***A63B 49/08*** | (2015.01) |
| ***A63B 60/28*** | (2015.01) |
| ***A63B 60/54*** | (2015.01) |
| ***A63B 49/035*** | (2015.01) |
| ***A63B 60/14*** | (2015.01) |
| *A63B 60/52* | (2015.01) |

(52) U.S. Cl.

CPC ..... *A63B 60/28* (2015.10); *A63B 49/035* (2015.10); *A63B 49/08* (2013.01); *A63B 60/14* (2015.10); *A63B 60/54* (2015.10); *A63B 60/52* (2015.10)

(58) Field of Classification Search

CPC ..... A63B 60/28; A63B 60/22; A63B 49/08; A63B 49/035; A63B 60/14; A63B 60/52; A63B 60/54

See application file for complete search history.

(56) References Cited

U.S. PATENT DOCUMENTS

| | | | | | |
|---|---|---|---|---|---|
| 3,539,185 | A * | 11/1970 | Andis | A63B 53/14 | 16/429 |
| 3,931,968 | A * | 1/1976 | Hedberg | A63B 49/08 | 16/429 |
| 4,149,721 | A * | 4/1979 | Strickland | A63B 49/035 | 473/549 |
| 4,641,838 | A * | 2/1987 | Gabrielidis | A63B 49/08 | 473/552 |
| 5,524,879 | A * | 6/1996 | Lyle | A63B 49/08 | 473/552 |
| 8,016,702 | B2 * | 9/2011 | Hagey | A63B 49/08 | 473/549 |
| 2014/0121031 | A1 * | 5/2014 | Aguinaldo | A63B 53/10 | 473/239 |
| 2018/0043225 | A1 * | 2/2018 | Lau | A63B 60/54 | |

FOREIGN PATENT DOCUMENTS

DE 3526593 A1 2/1987

* cited by examiner

*Primary Examiner* — Raleigh W Chiu
(74) *Attorney, Agent, or Firm* — Bookoff McAndrews, PLLC

(57) ABSTRACT

The present invention relates to a ball game racket, a method for adjusting the length of the handle portion of a ball game racket and a handle shell for the handle portion of a ball game racket.

20 Claims, 8 Drawing Sheets

HANDLE SHELL FOR BALL GAME RACKET

This patent application claims the benefit under 35 U.S.C. 119 to German Patent Application No. 10 2016 009 720.5, filed on Aug. 10, 2016, the entirety of which is incorporated herein by reference.

The present invention relates to a handle shell for a ball game racket, a ball game racket and a method for adjusting the length of the handle portion of a ball game racket.

Normally, the handle portion of a ball game racket comprises a handle core which is made, for example, by blow tube molding, and an outer region which is applied to the handle core and can be made, for example, from polyurethane and is foamed directly onto the handle core or is bonded thereto in the form of half shells. At the proximal end of the handle portion, which faces towards the player, additionally a handle or end cap, which is typically a plastics component, is attached to the handle (for example stapled to, bonded to or locked with the handle). Moreover, handle sleeves made from plastics are known, which are, for example, screwed to the handle core. Normally, a grip tape is wound around this external region of the handle portion.

All these known handle portions have in common that the external region is substantially irremovably connected to the handle core during manufacturing and should not be removed therefrom during the lifetime of the racket. However, the handle portion of a ball game racket is essential to the playing or handling behavior thereof, and many players would appreciate the possibility of adjusting the handle portion of their ball game racket to their personal requirements. For example, for a young player in his/her growth phase, the possibility of repeatedly elongating his/her racket might be advantageous.

DE 35 26 593 A1 discloses a tennis racket the shaft of which comprises an upper part having an out threading and a lower part having an inner threading. Thus, the lower part may be screwed onto the upper part of the shaft in order to adjust the length of the shaft. However, such a connection be means of a threading is disadvantageous in that it does not provide for a sufficiently stable and secure connection which would be necessary in view of the forces acting on said connection during play.

Therefore, it is an object of the present invention to provide a ball game racket which has an improved handle portion and can be used more flexibly. This object is achieved by a ball game racket according to claim 1. Preferred embodiments of the ball game racket according to the invention are described in the dependent claims.

Accordingly, the present invention is directed, i.a., to a ball game racket having a racket head and a handle portion. The handle portion comprises a handle core being integrally connected to the racket head and having an outer side and a handle shell having an inner side. The outer side of the handle core can engage with the inner side of the handle shell at different relative positions with respect to the longitudinal axis of the ball game racket in such a positive locking (i.e. positive fit or form closure) and/or friction locking (i.e. friction fit) that the positive and/or friction locking provides for a connection between the handle shell and the handle core that can be disconnected in a destruction-free manner.

In other words, the present invention is i.a. based on the idea not to connect the handle shell and the handle core permanently or inseparably, but to provide a connection which can be disconnected in a destruction-free manner and provides for the possibility to remove the handle shell from the handle core, to reposition it with respect to the handle core and to reconnect it to the handle core. Since the player interacts with the handle portion via the exterior handle shell, such a repositioning of the handle shell with respect to the handle core allows an effective length adjustment of the handle portion with respect to the ball game racket. A friction locking can be achieved, for example, in that the outer side of the handle core and/or the inner side of the handle shell has/have a particularly high coefficient of static friction. The coefficient of static friction between the outer side of the handle core and the inner side of the handle shell is preferably at least 0.2, more preferably at least 0.3 and particularly preferably at least 0.4. A positive locking can be realized preferably in that the outer side of the handle core and the inner side of the handle shell comprise elements which correspond with each other and can be engaged with each other. If a plurality of (regularly or irregularly) repeating elements are provided, the handle shell and the handle core can be engaged with each other in different relative positions with respect to the longitudinal axis of the ball game racket, so that it is also possible to attach the handle shell to different portions of the handle core.

The ball game racket preferably also comprises a grip tape which is wound around the handle shell and thus additionally attaches the handle shell to the handle core in such a manner that the connection can be disconnected in a destruction-free manner. In case of a friction locking, the grip tape can, for example, serve for increasing the normal force, leading to an increased static friction force. In case of a positive locking it is also conceivable that the positive connection only prevents movement of the handle shell within the plane defined by the stringing but does not restrict movability perpendicular therewith. In particular in such a case, the grip tape ensures that the handle shell cannot be disconnected from the handle core, wherein the positive locking between the handle shell and the handle core guarantees that the handle shell cannot slip along the longitudinal axis of the ball game racket.

Preferably, the connection between the handle shell and the handle core can be disconnected without the use of tools. For example, the handle shell can be made of two half shells, which can be disconnected without any problems along a direction perpendicular to the stringing of the racket as soon as the grip tape has been removed from the handle.

In order to provide for a corresponding flexibility in view of different relative positions of the handle shell with respect to the handle core (i.e. different handle lengths), it is preferred that the positive and/or friction locking can be realized at at least three, at least four, more preferably at least five, even more preferably at least six and particularly preferably at least seven different relative positions with respect to the longitudinal axis of the ball game racket. In the case of a positive locking, the number of possible relative positions is defined, i.a., by the number of elements at the outer side of the handle core and the inner side of the handle shell which can be engaged with each other. In the case of a friction locking, also infinite stepless relative positions are possible.

In a preferred embodiment, the positive and/or friction locking is a positive locking which can be realized at different discrete relative positions with respect to the longitudinal axis of the ball game racket. The offset between adjacent relative positions is preferably at most 10 mm, more preferably at most 8 mm, even more preferably at most 6 mm and particularly preferably at most 5 mm. With an offset between adjacent relative positions of, for example, 5 mm it is possible to adjust the length of the handle portion in steps of 5 mm to the personal requirements of the player. The smaller this offset, the more different relative positions should advantageously be provided in order to allow an accordingly large relative maximal displacement of the handle shell with respect to the handle core. Preferably, a total displacement of at least 15 mm, preferably at least 20 mm, more preferably at least 25 mm and particularly preferably at least 30 mm should be possible.

Preferably, the outer side of the handle core has a plurality of projections and/or depressions which are offset with respect to each other in the longitudinal direction, and the inner side of the handle shell has a plurality of corresponding depressions and/or projections which are offset with respect to each other in the longitudinal direction and can be engaged with the projections and/or depressions of the handle core. The projections and/or depressions can be ribs, struts, knobs, steps, notches, grooves and the like as well as the corresponding elements in the counterpart. Preferably, the projections and depressions are present in the form of struts or elongate grooves extending in a direction transverse, preferably orthogonal, with respect to the longitudinal direction of the handle portion. As far as manufacturing processes are concerned, it is particularly preferred that the depressions are provided at the outer side of the handle core and the corresponding projections are provided at the inner side of the handle shell. In view of the shapes and the dimensions of the depressions it is, i.a., relevant that these depressions can be made preferably by blow tube molding, which limits, for example, the radiuses of curvature of notches or grooves. The projections and/or depressions do not have to be symmetrical. Rather, also an asymmetric cross-section with, for example, flanks having different slopes can be provided, in order to account for varying loads in the proximal and the distal direction.

The distance between adjacent projections and/or depressions in the handle core and/or in the handle shell, which are offset with respect to each other in the longitudinal direction, is preferably substantially constant. The distance between adjacent projections and/or depressions which are offset with respect to each other in the longitudinal direction is preferably at most 10 mm, more preferably at most 8 mm, even more preferably at most 6 mm and particularly preferably at most 5 mm.

Preferably, the projections and/or depressions are provided in particular in the region of the handle portion in which the player surrounds the handle portion with his/her hand. This guarantees that the player additionally presses the depressions and/or projections against or into each other with his/her hand. In this connection it is preferred that the handle core comprises a distal end facing the racket head, a proximal end facing away from the racket head and a central portion, wherein the central portion is spaced from the proximal end by at least 2 cm, preferably at least 3 cm and particularly preferably at least 4 cm. Additionally or alternatively, the central portion is spaced from the distal end preferably by at least 3 cm, more preferably at least 5 cm and particularly preferably at least 7 cm. In this connection it is preferred that at least some of the projections and/or depressions and preferably all projections and/or depressions are provided in said central portion.

Basically, the handle core and the inner side of the handle shell can each have any corresponding cross-sectional profile. However, in view of a particularly effective positive locking, it turned out to be advantageous that the handle core has a substantially octagonal cross-sectional profile with four short edges and four long edges (wherein it is not necessary that all four long edges have the same edge length). In this case it is particularly preferred that the outer surfaces of the handle core which form the four short edges of the cross-sectional profile comprise at least some and preferably all projections and/or depressions. Preferably, projections and/or depressions are provided at all four short edges.

Basically, the projections and/or depressions of the handle core should correspond with the depressions and/or projections of the handle shell in such a manner that they can engage with each other at different relative positions of the handle shell with respect to the longitudinal axis of the ball game racket. To this end, for example a plurality of projections of the handle core have identical shapes and a plurality of depressions of the handle shell have identical shapes, so that a respective connection is possible at different relative positions. Moreover, the distances between the projections in the handle core as well as the distances between the depressions in the handle shell must suitably correspond with each other. However, it is not necessary that the number of projections in the handle core is the same as the number of depressions in the handle shell, and it is not necessary either that the distances between the projections in the handle core are identical to the distances between the depressions. Rather, it is also preferred that the handle core has more projections and/or depressions than the handle shell. It is also preferred that the distance between adjacent projections and/or depressions at the handle core, which are offset with respect to each other in the longitudinal direction, is smaller than the distance between adjacent depressions and/or projections at the handle shell, which are offset with respect to each other in the longitudinal direction. Thus, it is possible to make a relatively small offset in a simple and cost-efficient manner. Particularly preferably, the distance between adjacent depressions and/or projections at the handle shell, which are offset with respect to each other in the longitudinal direction, is twice as large as the distance between adjacent projections and/or depressions at the handle core, which are offset with respect to each other in the longitudinal direction.

The handle shell preferably comprises two half shells. The half shells of the handle shell are preferably connected with each other at an end in a hinged and/or flexible manner, so that the half shells can be folded apart in order to remove them from the handle core.

Preferably, the two half shells have identical designs. The handle core preferably has a plurality of projections and/or depressions which are offset with respect to each other in the longitudinal direction, and each of the two half shells of the handle shell has a plurality of corresponding depressions and/or projections which are offset with respect to each other in the longitudinal direction and which can engage with the projections and/or depressions of the handle core. The depressions and/or projections can be arranged identically in the two half shells. Alternatively, the depressions and/or projections can be arranged differently in the two half shells. However, it is preferred that the distances between adjacent depressions and/or projections which are offset with respect to each other in the longitudinal direction are substantially constant in both half shells. It is also preferred that the distances between adjacent depressions and/or projections which are offset with respect to each other in the longitudinal direction are identical in both half shells. Moreover, it is preferred that at least one dampening element is provided between the half shells. The dampening element can comprise one or a combination of the following materials: TPE, NBR, NR, CR, silicone. Preferably the dampening element has a Shore A hardness of at most 100, more preferably between 40 and 80 and particularly preferably between 50 and 70.

The handle shell preferably also comprises a handle cap which is preferably an integral element of the handle shell. The handle cap has preferably a receiving portion for releasably receiving an electronic component.

The present invention also relates to a method for adjusting the length of the handle portion of a ball game racket, wherein the ball game racket can have the preferred features discussed above. The handle portion of the ball game racket has a handle core and a handle shell which is removably connected to the handle core. According to the method of the invention, first the connection between the handle shell and the handle core is disconnected. Then, the relative position between handle core and handle shell is adjusted by repositioning the handle shell with respect to the longitudinal axis of the ball game racket. Finally, the outer side of the handle core is engaged with the inner side of the handle shell in the adjusted relative position in order to connect the handle shell to the handle core. Preferably, before the connection between the handle shell and the handle core is disconnected, the grip tape is wound off the handle portion, and subsequent to the renewed connection of the handle shell to the handle core, a grip tape is wound around the handle shell. Preferably, the connection between the handle shell and the handle core is disconnected in a destruction-free and particularly preferably tool-free manner. It is also preferred that the handle shell and the handle core are reconnected without using an adhesive. Preferably, the handle shell comprises two half shells (optionally with the preferred features discussed above). In this case, the step of disconnecting the handle shell and the handle core preferably comprises the folding or bending apart of the two half shells.

The present invention further relates to a handle shell for the handle portion of a ball game racket, wherein the handle shell comprises two half shells each having an inner side. On its inner side, each of the two half shells has a plurality of depressions and/or projections which are offset with respect to each other in the longitudinal direction and adapted to be engaged with corresponding projections and/or depressions of the handle portion of a ball game racket. The handle shell can have in particular the preferred features discussed above in view of the ball game racket.

The present invention is also directed to the following aspects:

1. A ball game racket comprising a racket head and a handle portion, wherein the handle portion comprises a handle core being integrally connected to the handle head and having an outer side and a handle shell having an inner side, wherein the outer side of the handle core can be engaged with the inner side of the handle shell at different relative positions with respect to the longitudinal axis of the ball game racket in such a positive locking and/or friction locking that the positive and/or friction locking provides for a connection between the handle shell and the handle core that can be disconnected in a destruction-free manner.
2. The ball game racket according to aspect 1, further comprising a grip tape which is wound around the handle shell and thus additionally attaches the handle shell to the handle core in such a manner that the connection can be disconnected in a destruction-free manner.
3. The ball game racket according to aspect 1 or 2, wherein the connection between the handle shell and the handle core can be disconnected without the use of tools.
4. The ball game racket according to any of the preceding aspects, wherein the positive and/or friction locking can be realized at at least three, preferably at least four, more preferably at least five different relative positions with respect to the longitudinal axis of the ball game racket.
5. The ball game racket according to any of the preceding aspects, wherein the positive and/or frictional engagement is substantially a positive locking and can be realized at different discrete relative positions with respect to the longitudinal axis of the ball game racket, wherein the offset between adjacent relative positions is at most 10 mm, preferably at most 8 mm, more preferably at most 6 mm and particularly preferably at most 5 mm.
6. The ball game racket according to any of the preceding aspects, wherein the handle core has a plurality of projections and/or depressions which are offset with respect to each other in the longitudinal direction and wherein the handle shell has a plurality of corresponding depressions and/or projections which are offset with respect to each other in the longitudinal direction and can be engaged with the projections and/or depressions of the handle core.
7. The ball game racket according to aspect 6, wherein the distance between adjacent projections and/or depressions which are offset with respect to each other in the longitudinal direction is substantially constant.
8. The ball game racket according to aspect 7, wherein the distance between adjacent projections and/or depressions which are offset with respect to each other in the longitudinal direction is at most 10 mm, preferably at most 8 mm, more preferably at most 6 mm and particularly preferably at most 5 mm.
9. The ball game racket according to any of aspects 6 to 8, wherein the handle core comprises a distal end facing the racket head, a proximal end facing away from the racket head and a central portion, wherein the central portion is spaced from the proximal end by at least 2 cm, preferably at least 3 cm and particularly preferably at least 4 cm and/or wherein the central portion is spaced from the distal end by at least 3 cm, preferably at least 5 cm and particularly preferably at least 7 cm, and wherein at least some, preferably all projections and/or depressions are provided in said central portion.
10. The ball game racket according to any of aspects 6 to 8, wherein the handle core has a substantially octagonal cross-sectional profile with four short edges and four long edges and wherein the outer surfaces of the handle core which form the four short edges of the cross-sectional profile comprise at least some, preferably all projections and/or depressions.
11. The ball game racket according to any of aspects 6 to 9, wherein the handle core has more projections and/or depressions than the handle shell and/or wherein the distance between adjacent projections and/or depressions at the handle core, which are offset with respect to each other in the longitudinal direction, is smaller than the distance between adjacent depressions and/or projections at the handle shell, which are offset with respect to each other in the longitudinal direction.
12. The ball game racket according to any of the preceding aspects, wherein the handle shell comprises two half shells.
13. The ball game racket according to aspect 12, wherein the half shells are connected with each other at an end in a hinged and/or flexible manner.
14. The ball game racket according to aspect 12 or 13, wherein the two half shells are identical.

15. The ball game racket according to any of aspects 12 to 14, wherein the handle core has a plurality of projections and/or depressions which are offset with respect to each other in the longitudinal direction, and wherein each of the two half shells of the handle shell has a plurality of corresponding depressions and/or projections which are offset with respect to each other in the longitudinal direction and which can engage with the projections and/or depressions of the handle core.
16. The ball game racket according to aspect 15, wherein the depressions and/or projections are arranged identically in the two half shells.
17. The ball game racket according to aspect 15, wherein the depressions and/or projections are arranged differently in the two half shells.
18. The ball game racket according to any of aspects 15 to 17, wherein the distances between adjacent depressions and/or projections which are offset with respect to each other in the longitudinal direction are substantially constant in both half shells.
19. The ball game racket according to any of aspects 15 to 18, wherein the distances between adjacent depressions and/or projections which are offset with respect to each other in the longitudinal direction are identical in both half shells.
20. The ball game racket according to any of aspects 12 to 19, wherein at least one dampening element is provided between the half shells.
21. The ball game racket according to any of the preceding aspects, wherein the handle shell comprises a handle cap which is preferably an integral element of the handle shell.
22. The ball game racket according to aspect 21, wherein the handle cap has a receiving portion for releasably receiving an electronic component.
23. A method for adjusting the length of the handle portion of a ball game racket, in particular a ball game racket according to any of the preceding aspects, wherein the handle portion of the ball game racket has a handle core and a handle shell which is removably connected to the handle core, the method comprising the following steps:
(a) disconnecting the connection between the handle shell and the handle core;
(b) adjusting the relative position between handle core and handle shell by repositioning the handle shell with respect to the longitudinal axis of the ball game racket;
(c) engaging the outer side of the handle core with the inner side of the handle shell in the adjusted relative position in order to connect the handle shell to the handle core.
24. The method according to aspect 23, further comprising the steps of winding off the grip tape before step (a) and winding a grip tape around the handle shell after step (c).
25. The method according to aspect 23 or 24, wherein step (a) is carried out in a destruction-free and preferably tool-free manner.
26. The method according to any of aspects 23 to 25, wherein step (c) is carried out without using an adhesive.
27. A handle shell for the handle portion of a ball game racket, wherein the handle shell comprises two half shells each having an inner side, wherein on its inner side, each of the two half shells has a plurality of depressions and/or projections which are offset with respect to each other in the longitudinal direction and adapted to engage with corresponding projections and/or depressions of the handle portion of a ball game racket.
28. The handle shell according to aspect 27, wherein the depressions and/or projections are arranged identically in the two half shells.
29. The handle shell according to aspect 27, wherein the depressions and/or projections are arranged differently in the two half shells.
30. The handle shell according to any of aspects 27 to 29, wherein the distances between adjacent depressions and/or projections which are offset with respect to each other in the longitudinal direction are substantially constant in both half shells.
31. The handle shell according to any of aspects 27 to 30, wherein the distances between adjacent depressions and/or projections which are offset with respect to each other in the longitudinal direction are identical in both half shells.
32. The handle shell according to any of aspects 27 to 31, wherein the distance between adjacent projections and/or depressions which are offset with respect to each other in the longitudinal direction is at most 10 mm, preferably at most 8 mm, more preferably at most 6 mm and particularly preferably at most 5 mm.
33. The handle shell according to any of aspects 27 to 32, wherein the handle shell comprises a distal end facing the racket head, a proximal end facing away from the racket head and a central portion, wherein the central portion is spaced from the proximal end by at least 2 cm, preferably at least 3 cm and particularly preferably at least 4 cm and/or wherein the central portion is spaced from the distal end by at least 3 cm, preferably at least 5 cm and particularly preferably at least 7 cm, and wherein at least some, preferably all depressions and/or projections are provided in said central portion.
34. The handle shell according to any of aspects 27 to 33, wherein the inner side of the handle shell has a substantially octagonal cross-sectional profile with four short edges and four long edges and wherein the inner surfaces of the handle shell which form the four short edges of the cross-sectional profile comprise at least some and preferably all depressions and/or projections.
35. The handle shell according to any of aspects 27 to 34, wherein at least one dampening element is provided between the half shells.
36. The handle shell according to any of aspects 27 to 35, wherein the handle shell comprises a handle cap.
37. The handle shell according to aspect 36, wherein the handle cap is an integral element of the handle shell.
38. The handle shell according to aspect 36 or 37, wherein the handle cap is firmly connected to one half shell and can be releasably connected to the other half shell.
39. The handle shell according to aspect 36 or 37, wherein the handle cap is formed of two parts and wherein a first part of the handle cap is an integral component of one half shell and a second part of the handle cap is an integral component of the other half shell.
40. The handle shell according to any of aspects 36 to 39, wherein the handle cap has a receiving portion for releasably receiving an electronic component.
41. The handle shell according to any of aspects 27 to 40, wherein the half shells of the handle shell are connected with each other at an end in a hinged and/or flexible manner.
42. The handle shell according to any of aspects 27 to 41, wherein the half shells of the handle shell are identical.
43. A ball game racket comprising a racket head and a handle portion, wherein the handle portion comprises a handle core being integrally connected to the racket head and having an outer side and a handle shell according to any of aspects 27 to 42 and having an inner side, wherein the outer side of the handle core can engage with the inner side of the handle shell at different relative positions with respect to the longitudinal axis of the ball game racket in such a positive locking and/or friction locking that the positive and/or friction locking provides for a connection between the handle shell and the handle core that can be disconnected in a destruction-free manner.

In the following, preferred embodiments of the present invention are described in more detail with reference to the Figures in which FIG. 1 shows a perspective view of the handle portion of a ball game racket according to a preferred embodiment of the present invention in which the handle shell is partly removed;

Figure 1:
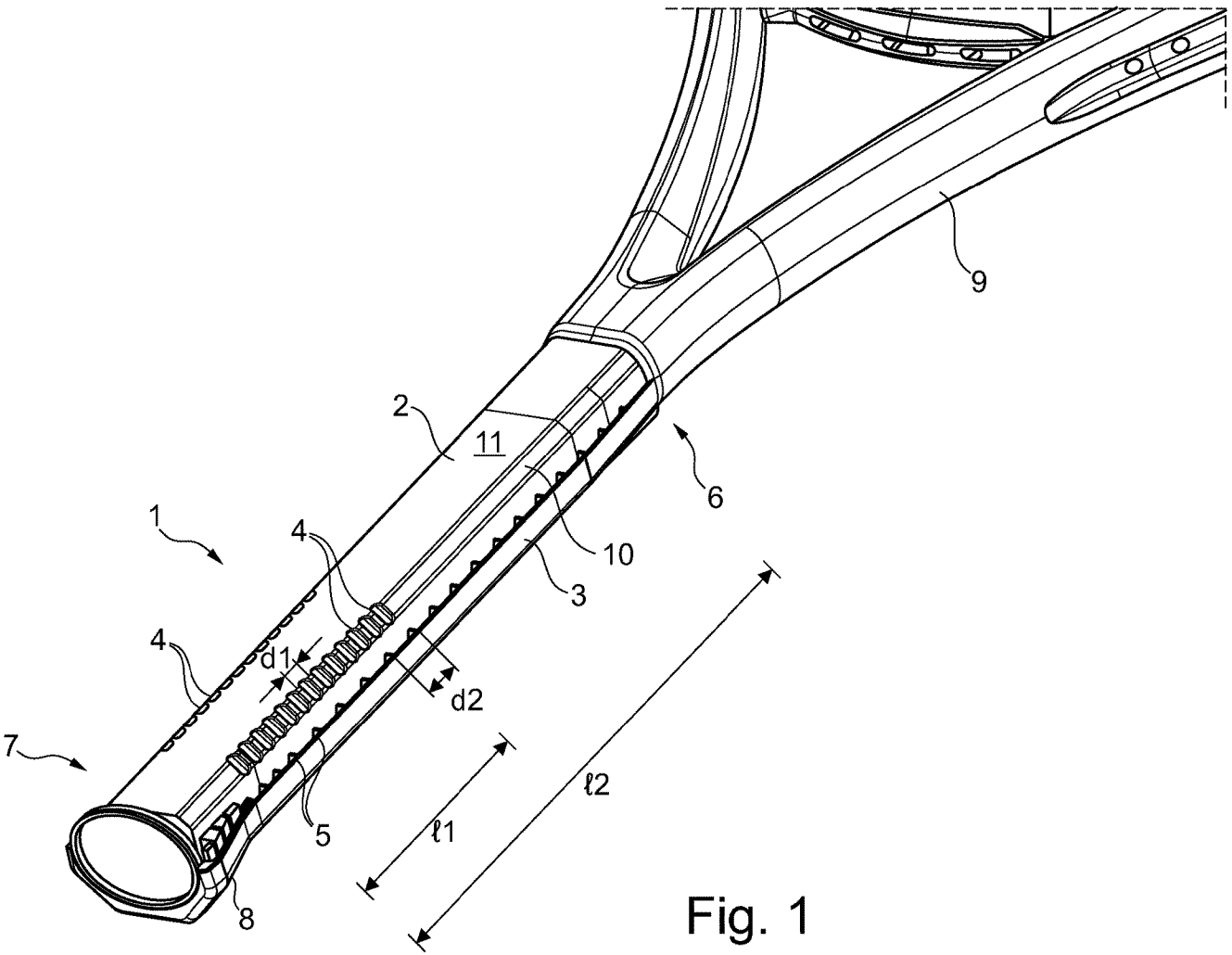
Figure 2:
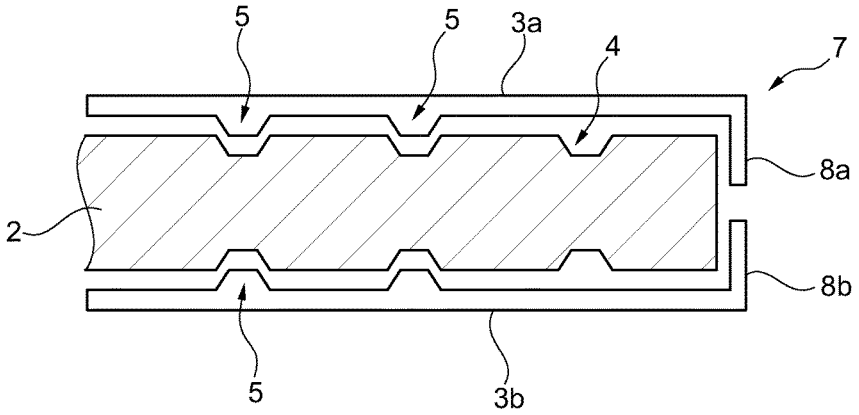
FIG. 2 shows a schematic longitudinal sectional view of the handle portion of a ball game racket according to a preferred embodiment of the present invention.
Figure 3:
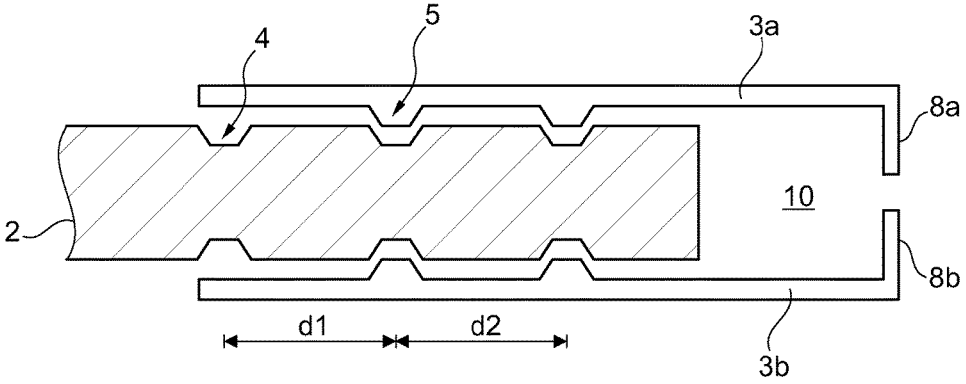
FIG. 3 shows a schematic longitudinal sectional view of the handle portion according to FIG. 2.

FIG. 1 shows a perspective view of the handle portion 1 of a ball game racket according to a preferred embodiment of the present invention. In addition to the handle portion 1, the ball game racket has a racket head (only indicated) which is connected to the handle portion 1 of the ball game racket by means of a heart region 9. The handle portion 1 comprises a handle core 2 being integrally connected to the racket head and having an outer side and a racket shell 3 (only partly shown in FIG. 1) having an inner side. The outer side of the handle core 2 can be engaged with the inner side of the handle shell 3 at different relative positions (one of them being shown in FIG. 1) with respect to the longitudinal axis of the ball game racket in such a positive locking that the positive locking provides for a connection between the handle shell 3 and the handle core 2 that can be disconnected in a destruction-free manner. In the shown preferred embodiment, this positive locking is realized in that the handle core 2 has a plurality of depressions 4 which are offset with respect to each other in the longitudinal direction (of the handle portion or the ball game racket) and the handle shell 3 has a plurality of corresponding projections 5 which are offset with respect to each other in the longitudinal direction and can be engaged with the depressions 4 of the handle core 2. This principle is schematically shown in FIGS. 2 and 3 in which the handle core 2 has three respective depressions or grooves 4 on two opposing outer surfaces and the two half shells 3*a* and 3*b* forming the handle shell 3 each have two projecting ribs or struts 5. These projecting ribs or struts 5 can be engaged with different depressions or grooves 4 of the handle core 2, as evident from a comparison of FIGS. 2 and 3, so that the outer side of the handle core 2 can be engaged in a positively locking manner with the inner side of the handle shell 3 at different relative positions with respect to the longitudinal axis of the ball game racket. Thus, in view of the starting position shown in FIG. 2, the effective length of the handle portion can be increased (see FIG. 3) in that the handle shell 3 projects in the proximal direction beyond the handle core 2. At the proximal end of the handle portion, a hollow space 10 is thus formed. In order for the latter not having a negative effect on the stability of the handle portion, it is preferred to make the handle shell 3 from a material that is as stable as possible, for example ABS. Further suitable materials include PET, PA, TPE, PC, PVC, PBT, PE, PP as well as their common blends. However, ABS is a particularly preferred material in view of its high impact resistance and its small moisture expansion. A further preferred material is Terblend® (a mixture of ABS and PA).

The distance d1 between adjacent depressions 4 in the handle core 2 is preferably at most 10 mm, more preferably at most 8 mm, even more preferably at most 6 mm and particularly preferably at most 5 mm. Moreover, it is preferred that the distance d1 is constant for all depressions 4 on one side of the handle core 2. Preferably, the distance d1 is also identical for different sides of the handle core 2. In the shown preferred embodiment according to FIGS. 2 and 3, the distance d2 between adjacent projections 5 is the same as the distance d1. The distances d2 of a half shell of the handle shell 3 are preferably constant. Moreover, it is preferred that the distances d2 in one half shell 3*a* are identical to the distances d2 in the second half shell 3*b*.

Figure 6:
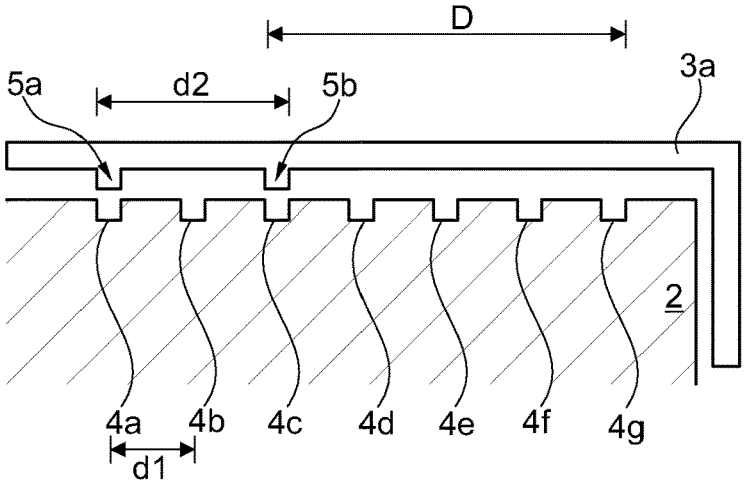
FIG. 6 shows a schematic longitudinal sectional view of a part of the handle portion of a ball game racket according to a preferred embodiment of the present invention.

However, the distance d2 between adjacent projections does not have to be equal to the distance d1 between adjacent depressions. For example, the distance d2 can be larger than the distance d1 and, in particular, correspond to an integer multiple of the distance d1. FIG. 6 only exemplarily shows an embodiment in which the distance d2 between adjacent projections 5*a* and 5*b* is twice as large as the distance d1 between adjacent depressions 4. The accuracy with which the offset between the handle shell 3 and the handle core 2 can be adjusted is determined by the distance d1: If the handle shell 3*a* is moved in the proximal direction so that the projections 5*a* and 5*b* engage with the depressions 4*b* and 4*d*, an offset by the distance d1 is achieved between the handle shell 3*a* and the handle core 3 as compared to the situation shown in FIG. 6. This leads to an easier and more cost-efficient manufacturing of the handle shell 3 because less projections having larger distances between each other must be produced. Of course also the reverse situation would be conceivable, in which less projections having larger distances between each other are provided in the handle core and more projections having smaller distances between each other in the handle shell. However, the option shown in FIG. 6 is preferred because the depressions in the handle shell can have a negative effect on its stability.

A further relevant parameter is the overall distance D by which the handle shell 3 can be moved between the most distal position and the most proximal position. In FIG. 6, this overall distance D is defined by the distance between the depression 4*c* and the depression 4*g* and thus corresponds in the present embodiment to four times the distance d1 (provided that the two shown projections 5*a* and 5*b* are engaged with respective projections 4*e* and 4*g*). The minimum offset (which corresponds to the distance d1 in the embodiment of FIG. 6) is preferably at most 10 mm, more preferably at most 8 mm, even more preferably at most 6 mm and particularly preferably at most 5 mm. The maximum offset D is preferably at least 2 cm, more preferably at least 3 cm, even more preferably at least 4 cm and particularly preferably at least 5 cm.

Figure 4:
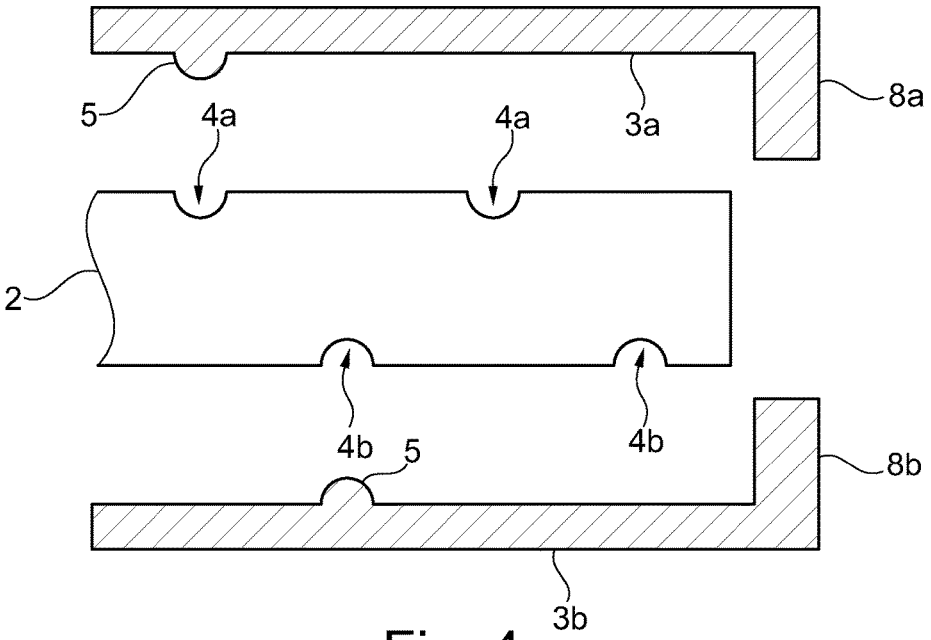
FIG. 4 shows a schematic longitudinal sectional view of the handle portion of a ball game racket according to a preferred embodiment of the present invention.

Basically, the projections and depressions can have any desired shape. However, it is preferred that the projections and depressions are present in the form of struts or elongate grooves extending in a direction transversely with respect to the longitudinal direction of the handle portion. The cross-section of these struts or grooves can also be arbitrary and can be, for example, rectangular (see FIG. 6), round (see FIGS. 4 and 5) or trapezoidal (see FIGS. 2 and 3). In view of a connection that is as simple as possible, a cross-section with tapering sides, such as, for example, the trapezoidal cross-section shown in FIGS. 2 and 3, is advantageous. The trapezoid can be symmetrical or asymmetrical, for example in order to account for different forces in the proximal and distal directions.

Figure 5:
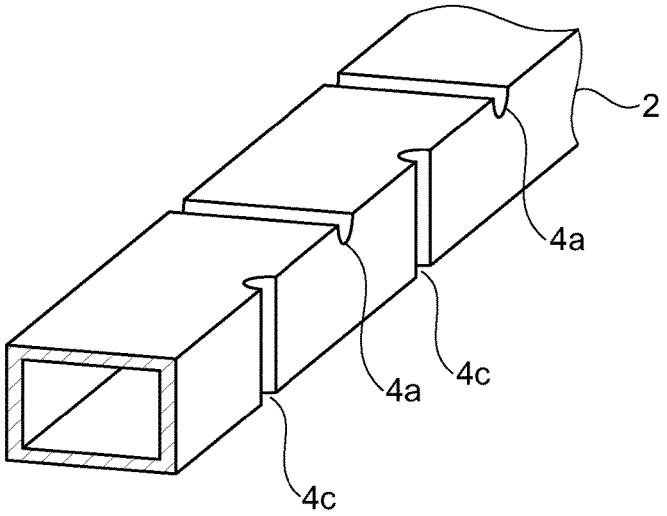
FIG. 5 shows a schematic perspective view of the handle portion of a ball game racket according to a preferred embodiment of the present invention.

A relatively small minimum offset using as little projections as possible can be achieved by means of different distances d1 and d2, as discussed above with reference to FIG. 6. Alternatively or additionally, the projections or depressions can also be arranged in different manners on different sides of the handle core 2 or in the different half shells 3*a* and 3*b* of the handle shell 3, as exemplarily shown in FIGS. 4 and 5. By rotating the handle shell 3 by 90° (see FIG. 5) or by 180° (see FIG. 4) about the longitudinal axis of the racket, different offsets of the handle shell with respect to the handle core can be achieved. Preferably, the offset between depressions 4*a* on one side of the handle core 2 and the adjacent depressions 4*b* on the opposite side of the handle core 2 (see FIG. 4B) corresponds to half the distance d1 between adjacent depressions 4 on one and the same side. Analogously, this also applies to the offset between adjacent depressions 4*a* on one side and adjacent depressions 4*c* on an adjacent side of the handle core 2, as shown in FIG. 5.

Figure 8:
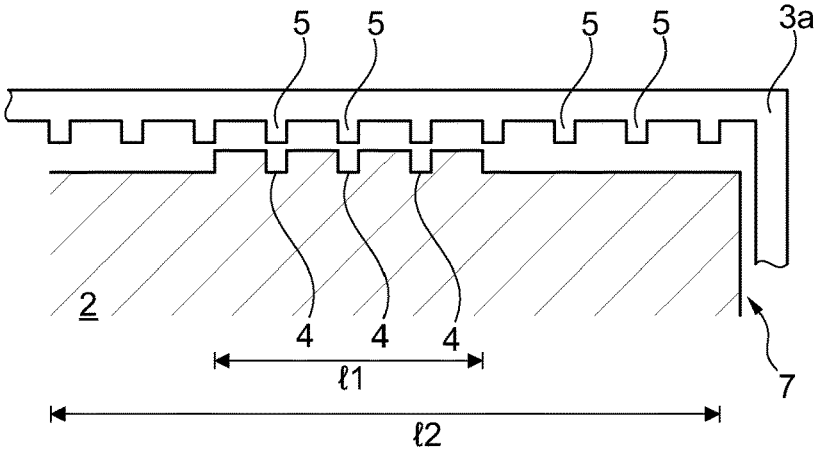
FIG. 8 shows a schematic longitudinal sectional view of a part of the handle portion of a ball game racket according to a preferred embodiment of the present invention.

In the embodiment of FIGS. 2 and 3, each of the projections 5 of the handle shell 3 is engaged with some of the depressions 4 of the handle core 2. This is also the case in the further embodiments according to FIGS. 4 to 6. However, this is not necessary, as shown in the preferred embodiment according to FIG. 1 and the schematic view according to FIG. 8. According thereto, the depressions 4 in the handle core 2 can be provided in a raised region (or can be formed by forming complementary projections). Along this raised region, a respective projection 5 is engaged with a corresponding depression 4. Outside this raised region, however, the respective projections 5 are not engaged with any of the depressions. Preferably, the length 11 of this raised region is larger than 4 cm, more preferably larger than 5 cm, even more preferably larger than 6 cm and particularly preferably larger than 7 cm. The length 12 of the region of the handle shell 3 in which projections 5 are provided is preferably larger than 6 cm, more preferably larger than 8 cm, even more preferably larger than 10 cm and particularly preferably larger than 12 cm. The distance of the raised region (or the central portion of the handle core in which projections and/or depressions are provided) from the proximal end 7 of the handle core is preferably at least 2 cm, more preferably at least 3 cm and particularly preferably at least 4 cm. The distance of the raised region or the central portion from the distal end of the handle core is preferably at least 3 cm, more preferably at least 5 cm and particularly preferably at least 7 cm.

Figure 7:
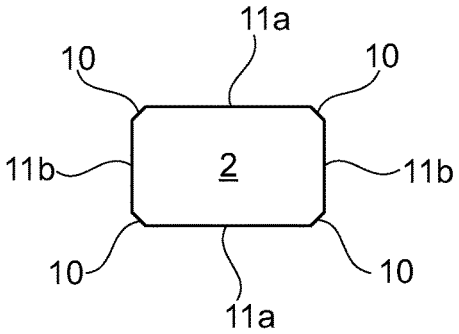
FIG. 7 shows a schematic cross-sectional view of the handle portion according to FIG. 1.

Since the shape of the handle portion sensed by the player is defined by the outer side of the handle shell, the cross-section of the handle core or the inner side of the handle shell can have any desired shape and can be, for example, rectangular or square. However, it turned out to be particularly advantageous that the handle core has a substantially octagonal cross-sectional profile (see FIG. 7) with four short edges 10 and four long edges 11*a*, 11*b*. It is preferred that the outer surfaces of the handle core 2 which form the four short edges 10 of the cross-sectional profile comprise the projections and/or depressions, as shown in FIG. 1. It is preferred that all four outer surfaces forming the short edges 10 have projections and/or depressions. Moreover, it is preferred that the outer surfaces of the handle core which form the remaining edges 11*a* and 11*b* do not have any projections and/or depressions.

Figure 9:
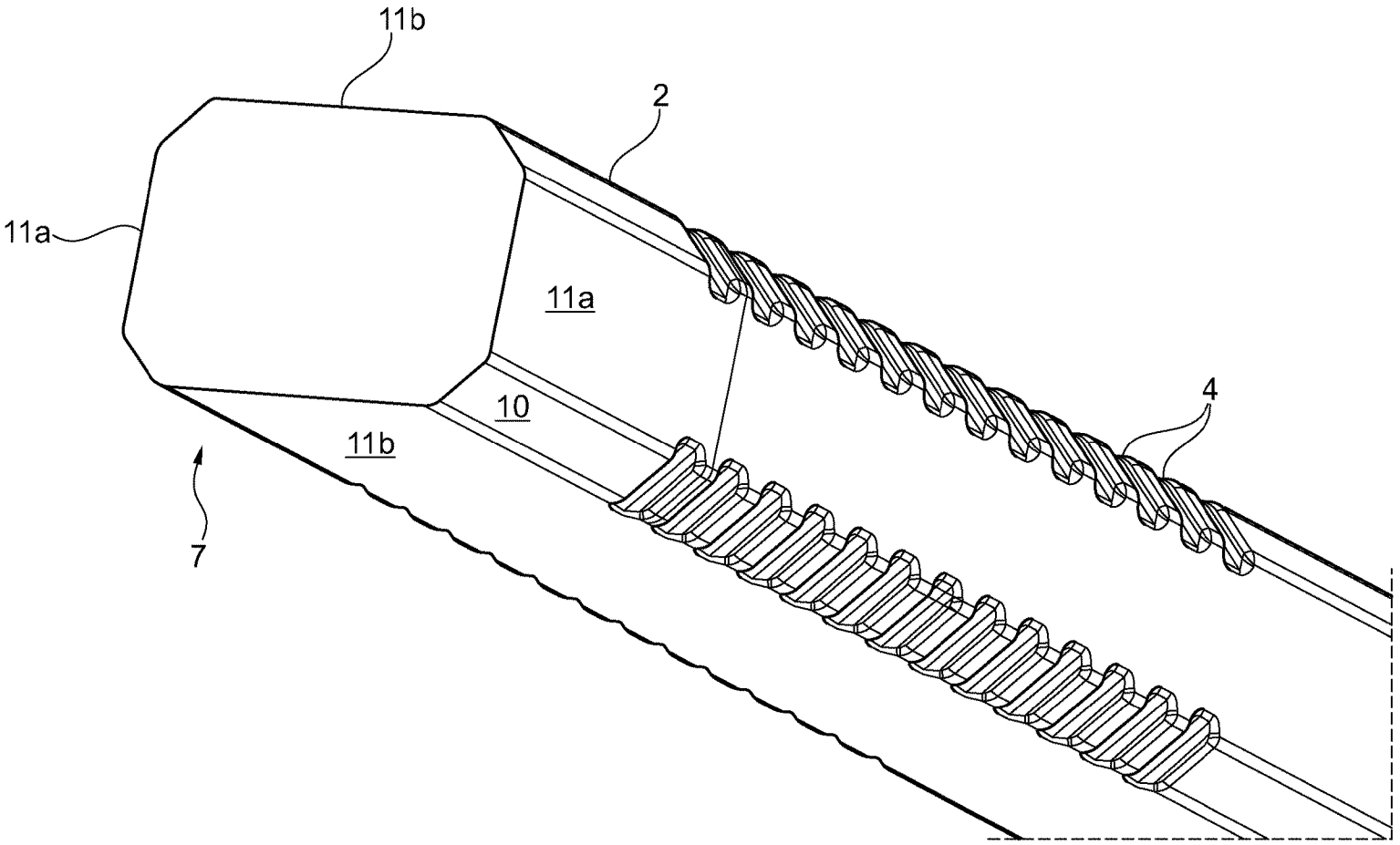
FIG. 9 shows a perspective view of the handle core of a handle portion of a ball game racket according to a preferred embodiment of the present invention.

FIGS. 9 to 12 show different views of a handle portion of a ball game racket according to a preferred embodiment of the present invention. FIG. 9 shows the handle core 2 including its proximal end 7 with a substantially octagonal cross-sectional profile with four short edges 10 and four long edges 11*a*, 11*b*. In the shown preferred embodiment, all four outer surfaces of the handle core 2 which form the four short edges 10 of the cross-sectional profile have depressions 4 having an approximately trapezoidal cross-sectional profile with rounded corners. In the shown preferred embodiment, each outer surface has 13 depressions 4. The present invention is of course not restricted to a specific number of depressions, but it is also possible to provide more or less than 13 depressions. However, it is preferred that at least six, more preferably at least eight, even more preferably at least ten and particularly preferably at least twelve depressions are provided per outer side, wherein it is not necessary that all outer sides and all outer sides forming the short edges have depressions.

Figure 10:
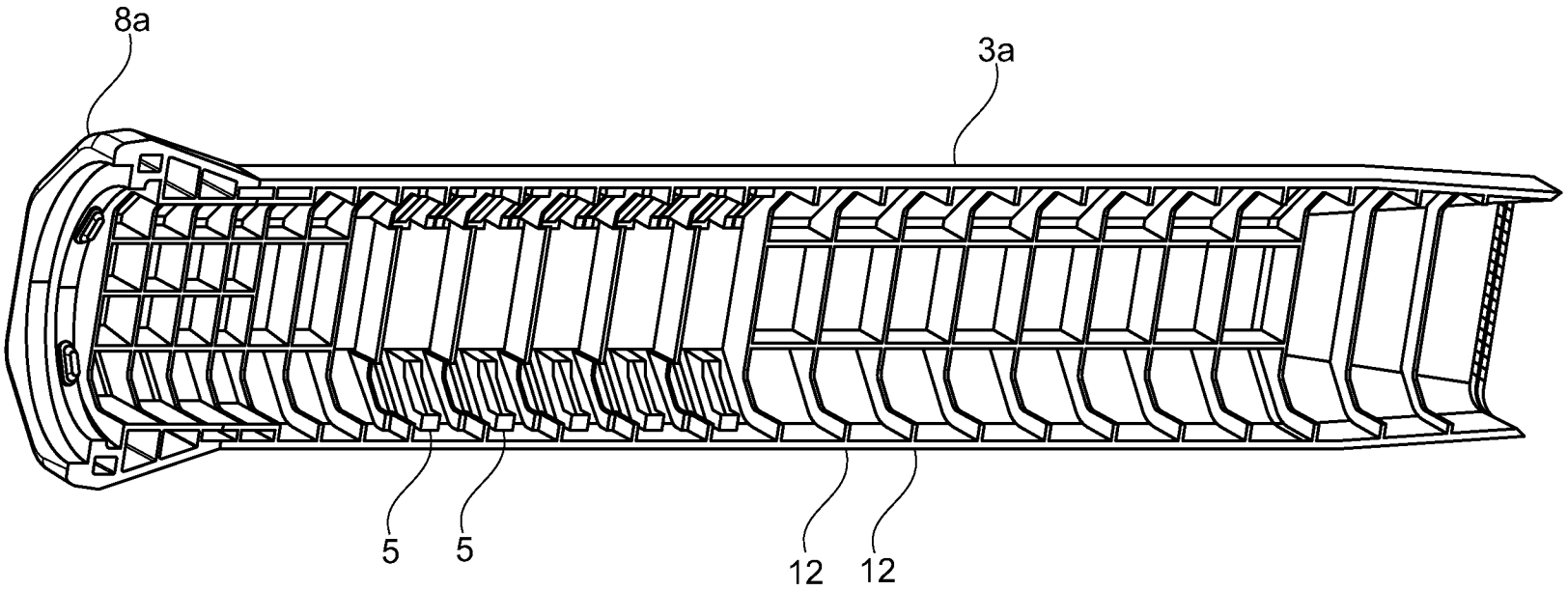
FIG. 10 shows a perspective view of a handle half shell according to a preferred embodiment of the present invention.

FIG. 10 shows, as counterpart to the handle core 2 according to FIG. 9, a handle half shell 3*a* with a corresponding half 8*a* of a handle cap, which is integrally formed with the handle half shell 3*a*. In the regions which are engaged with the short edges of the handle core 2, the inner side of the handle half shell 3*a* has five respective projections 5 which are configured such that they can engage in a positive locking with the depressions 4 of the handle core 2. The present invention is of course not restricted to a specific number of projections, but it is also possible to provide more or less than five projections. However, it is preferred that at least two, more preferably at least three, even more preferably at least four and particularly preferably at least five projections are present per region, wherein each half shell can also have only one region with projections. The inner side of the handle half shell 3*a* can comprise further strengthening ribs or webs 12 which, however, are not adapted to engage with the depressions 4 of the handle core 2. Rather, they serve for stabilizing the handle half shell.

Figure 11:
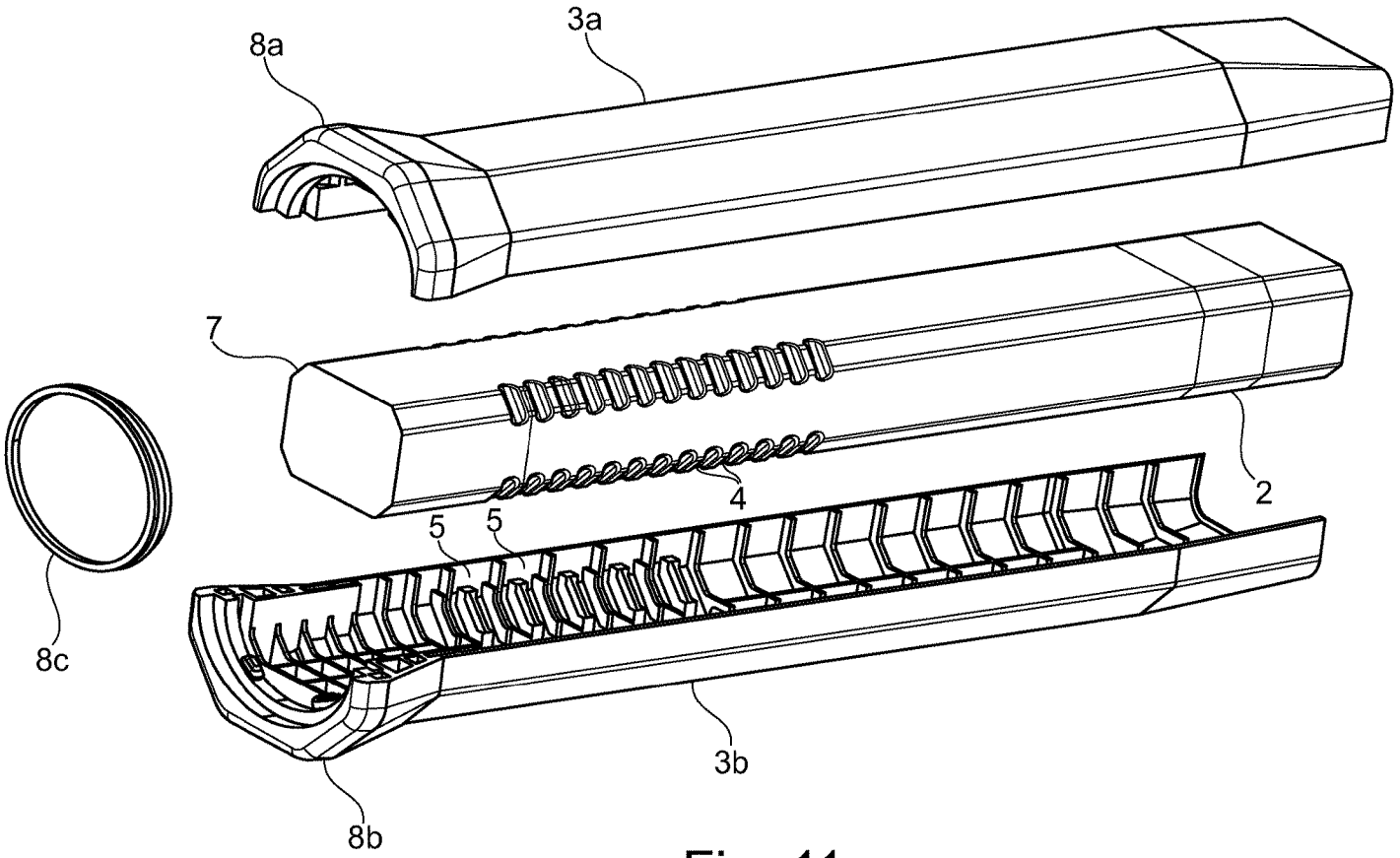
FIG. 11 shows a perspective view of the handle core and the handle shell of a handle portion of a ball game racket according to a preferred embodiment of the present invention.

FIG. 11 shows the individual components of the handle portion of a ball game racket according to a preferred embodiment of the present invention, comprising a handle core 2 (according to FIG. 9), two handle half shells 3*a* and 3*b* (according to FIG. 10) as well as a handle cap cover 8*c* which, together with the two halves 8*a* and 8*b* of the handle cap, forms the handle cap. Even if a separate handle cap cover 8*c* is provided in this embodiment, it is also possible that the handle cap cover is formed integrally with one of the two halves 8*a* and 8*b* of the handle cap. Alternatively, it is possible that each of the two halves 8*a* and 8*b* of the handle cap comprises also a part, preferably a half, of the handle cap cover.

Figure 12:
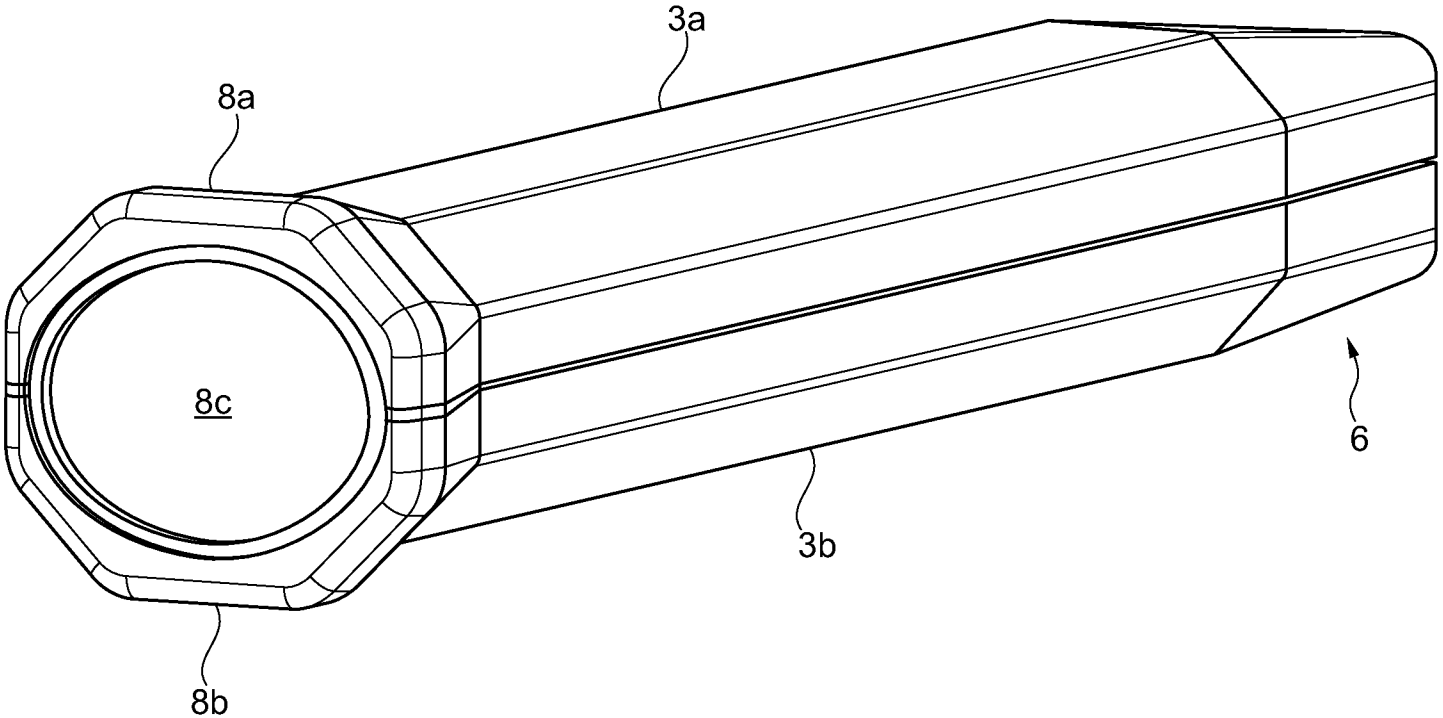
FIG. 12 shows a perspective view of the handle portion of a ball game racket according to a preferred embodiment of the present invention with mounted handle shell.

FIG. 12 shows the finished handle portion being mounted from the components according to FIG. 11. It is evident that the handle core 2 is completely enclosed by the two handle half shells 3*a* and 3*b* and the handle cap cover 8*c*, so that the handle core 2 is only visible distally of the distal end 6 of the handle shell 3 (not shown in FIG. 12). Preferably, the distal end 6 of the handle shell 3 tapers conically, as shown in FIGS. 11 and 12, in order to provide for a transition between handle shell 3 and handle core 2 that is as stepless as possible.

The invention claimed is:

1. A ball game racket comprising a racket head and a handle portion, wherein the handle portion comprises a handle core being integrally connected to the handle head and having an outer side and a handle shell having an inner side, wherein the outer side of the handle core can be engaged with the inner side of the handle shell at different discrete relative positions with respect to the longitudinal axis of the ball game racket in such a positive locking and/or friction locking that the positive and/or friction locking provides for a connection between the handle shell and the handle core that can be disconnected in a destruction-free manner, wherein the handle core has a plurality of projections and/or depressions which are offset with respect to each other in the longitudinal direction and wherein the handle shell has a plurality of corresponding depressions and/or projections which are offset with respect to each other in the longitudinal direction and can be engaged with the projections and/or depressions of the handle core, wherein the handle core has more projections and/or depressions than the handle shell.

2. The ball game racket according to claim 1, further comprising a grip tape which is wound around the handle shell and thus additionally attaches the handle shell to the handle core in such a manner that the connection can be disconnected in a destruction-free manner.

3. The ball game racket according to claim 1, wherein the connection between the handle shell and the handle core can be disconnected without the use of tools.

4. The ball game racket according to claim 1, wherein the positive and/or friction locking can be realized at at least three different relative positions with respect to the longitudinal axis of the ball game racket.

5. The ball game racket according to claim 1, wherein the positive and/or friction locking is substantially a positive locking and can be realized at different discrete relative positions with respect to the longitudinal axis of the ball game racket, wherein the offset between adjacent relative positions is at most 10 mm.

6. The ball game racket according to claim 1, wherein the distance between adjacent projections and/or depressions which are offset with respect to each other in the longitudinal direction is substantially constant.

7. The ball game racket according to claim 6, wherein the distance between adjacent projections and/or depressions which are offset with respect to each other in the longitudinal direction is at most 10 mm.

8. The ball game racket according to claim 1, wherein the handle core comprises a distal end facing the racket head, a proximal end facing away from the racket head and a central portion, wherein the central portion is spaced from the proximal end by at least 2 cm and wherein at least some projections and/or depressions are provided in said central portion.

9. The ball game racket according to claim 8, wherein the central portion is spaced from the distal end by at least 3 cm.

10. The ball game racket according to claim 1, wherein the handle core has a substantially octagonal cross-sectional profile with four short edges and four long edges and wherein the outer surfaces of the handle core which form the four short edges of the cross-sectional profile comprise at least some projections and/or depressions.

11. The ball game racket according to claim 1, wherein the distance between adjacent projections and/or depressions at the handle core, which are offset with respect to each other in the longitudinal direction, is smaller than the distance between adjacent depressions and/or projections at the handle shell, which are offset with respect to each other in the longitudinal direction.

12. The ball game racket according to claim 1, wherein the handle shell comprises two half shells which are connected with each other at an end in a hinged and/or flexible manner.

13. The ball game racket according to claim 12, wherein at least one dampening element is provided between the half shells.

14. The ball game racket according to claim 1, wherein the handle shell comprises a handle cap which is an integral element of the handle shell, wherein the handle cap has a receiving portion for releasably receiving an electronic component.

15. A method for adjusting the length of the handle portion of a ball game racket according to claim 1, the method comprising the following steps:

(a) disconnecting the connection between the handle shell and the handle core;

(b) adjusting the relative position between handle core and handle shell by repositioning the handle shell with respect to the longitudinal axis of the ball game racket; and (c) engaging the outer side of the handle core with the inner side of the handle shell in the adjusted relative position in order to connect the handle shell to the handle core.

16. The method according to claim 15, further comprising the steps of winding off the grip tape before step (a) and winding a grip tape around the handle shell after step (c).

17. The method according to claim 15, wherein step (a) is carried out in a destruction-free manner and wherein step (c) is carried out without using an adhesive.

18. The method according to claim 15, wherein step (a) is carried out in a tool-free manner and wherein step (c) is carried out without using an adhesive.

19. A ball game racket comprising a racket head and a handle portion, wherein the handle portion comprises a handle core being integrally connected to the handle head and having an outer side and a handle shell having an inner side, wherein the outer side of the handle core can be engaged with the inner side of the handle shell at different discrete relative positions with respect to the longitudinal axis of the ball game racket in such a positive locking and/or friction locking that the positive and/or friction locking provides for a connection between the handle shell and the handle core that can be disconnected in a destruction-free manner, wherein the handle core has a plurality of projections and/or depressions which are offset with respect to each other in the longitudinal direction and wherein the handle shell has a plurality of corresponding depressions and/or projections which are offset with respect to each other in the longitudinal direction and can be engaged with the projections and/or depressions of the handle core, wherein the distance between adjacent projections and/or depressions at the handle core, which are offset with respect to each other in the longitudinal direction, is smaller than the distance between adjacent depressions and/or projections at the handle shell, which are offset with respect to each other in the longitudinal direction.

20. A ball game racket comprising a racket head and a handle portion, wherein the handle portion comprises a handle core being integrally connected to the handle head and having an outer side and a handle shell having an inner side, wherein the outer side of the handle core can be engaged with the inner side of the handle shell at different discrete relative positions with respect to the longitudinal axis of the ball game racket in such a positive locking and/or friction locking that the positive and/or friction locking provides for a connection between the handle shell and the handle core that can be disconnected in a destruction-free manner, wherein the handle core has a plurality of projections and/or depressions which are offset with respect to each other in the longitudinal direction and wherein the handle shell has a plurality of corresponding depressions and/or projections which are offset with respect to each other in the longitudinal direction and can be engaged with the projections and/or depressions of the handle core, wherein the handle core has a substantially octagonal cross-sectional profile with four short edges and four long edges and wherein the outer surfaces of the handle core which form the four short edges of the cross-sectional profile comprise at least some projections and/or depressions.

* * * * *